US007862487B2

(12) United States Patent
Olson

(10) Patent No.: US 7,862,487 B2
(45) Date of Patent: Jan. 4, 2011

(54) FREESTANDING SELECTABLE FREE WEIGHT ASSEMBLY

(76) Inventor: Lawrence B. Olson, 6660 Delmonico Dr., STE D283, Colorado Springs, CO (US) 80919

( * ) Notice: Subject to any disclaimer, the term of this patent is extended or adjusted under 35 U.S.C. 154(b) by 0 days.

(21) Appl. No.: 12/262,478

(22) Filed: Oct. 31, 2008

(65) Prior Publication Data

US 2009/0197745 A1 Aug. 6, 2009

Related U.S. Application Data

(60) Provisional application No. 61/025,317, filed on Feb. 1, 2008.

(51) Int. Cl.
*A63B 21/075* (2006.01)

(52) U.S. Cl. ..... 482/108; 482/98

(58) Field of Classification Search ..... 482/92–98, 482/104–109, 908; D21/681, 682
See application file for complete search history.

(56) References Cited

U.S. PATENT DOCUMENTS

| | | | | |
|---|---|---|---|---|
| 5,769,762 | A * | 6/1998 | Towley et al. | 482/93 |
| 6,083,144 | A * | 7/2000 | Towley et al. | 482/107 |
| 6,149,558 | A * | 11/2000 | Chen | 482/107 |
| 6,196,952 | B1 * | 3/2001 | Chen | 482/107 |
| 6,228,003 | B1 * | 5/2001 | Hald et al. | 482/107 |
| 6,261,022 | B1 * | 7/2001 | Dalebout et al. | 482/107 |
| 6,500,101 | B1 * | 12/2002 | Chen | 482/107 |
| 6,540,650 | B1 * | 4/2003 | Krull | 482/107 |
| 6,758,795 | B2 * | 7/2004 | Barber | 482/106 |
| 7,090,625 | B2 * | 8/2006 | Chermack | 482/108 |
| 7,153,244 | B2 * | 12/2006 | Towley et al. | 482/108 |
| 7,264,578 | B1 * | 9/2007 | Krull | 482/108 |
| 7,335,142 | B2 * | 2/2008 | Towley et al. | 482/107 |
| 7,377,885 | B2 * | 5/2008 | Doudiet | 482/107 |
| 7,387,596 | B2 * | 6/2008 | Towley et al. | 482/108 |
| 7,491,155 | B2 * | 2/2009 | Fenelon et al. | 482/107 |
| 7,497,814 | B1 * | 3/2009 | Krull | 482/108 |
| 7,520,845 | B2 * | 4/2009 | Towley et al. | 482/106 |
| 7,547,268 | B1 * | 6/2009 | Krull | 482/98 |
| 7,578,772 | B2 * | 8/2009 | Lippitt | 482/108 |
| 7,611,448 | B2 * | 11/2009 | Schiff | 482/107 |
| 7,621,855 | B1 * | 11/2009 | Krull | 482/107 |
| 2003/0096683 | A1 * | 5/2003 | Fenelon et al. | 482/107 |
| 2003/0114276 | A1 * | 6/2003 | Schiff | 482/93 |
| 2003/0148862 | A1 * | 8/2003 | Chen et al. | 482/108 |
| 2008/0064575 | A1 * | 3/2008 | Towley et al. | 482/107 |
| 2009/0163335 | A1 * | 6/2009 | Towley et al. | 482/107 |

* cited by examiner

*Primary Examiner*—Loan Thanh
*Assistant Examiner*—Daniel F Roland
(74) *Attorney, Agent, or Firm*—Senniger Powers LLP

(57) ABSTRACT

This freestanding selectable free weight assembly includes an annular handle assembly that supports a weight set about each end. Each weight set includes end wedge assemblies with slanted interior faces and a set of slanted weight plates are sandwiched between the inner and outer slanted end wedge assemblies. Selectively movable rods are housed within the annular handle assembly. The user can actuate the movable rods to move underneath and support a defined number of weight plates to control the amount of weight disposed about each end of the handle. The weight plates are interconnected by a tang projecting to the side of each plate where each tang is adjacent to a locking slot. Each tang fits into a locking slot of each adjacent weight plate.

11 Claims, 8 Drawing Sheets

FIG. 5
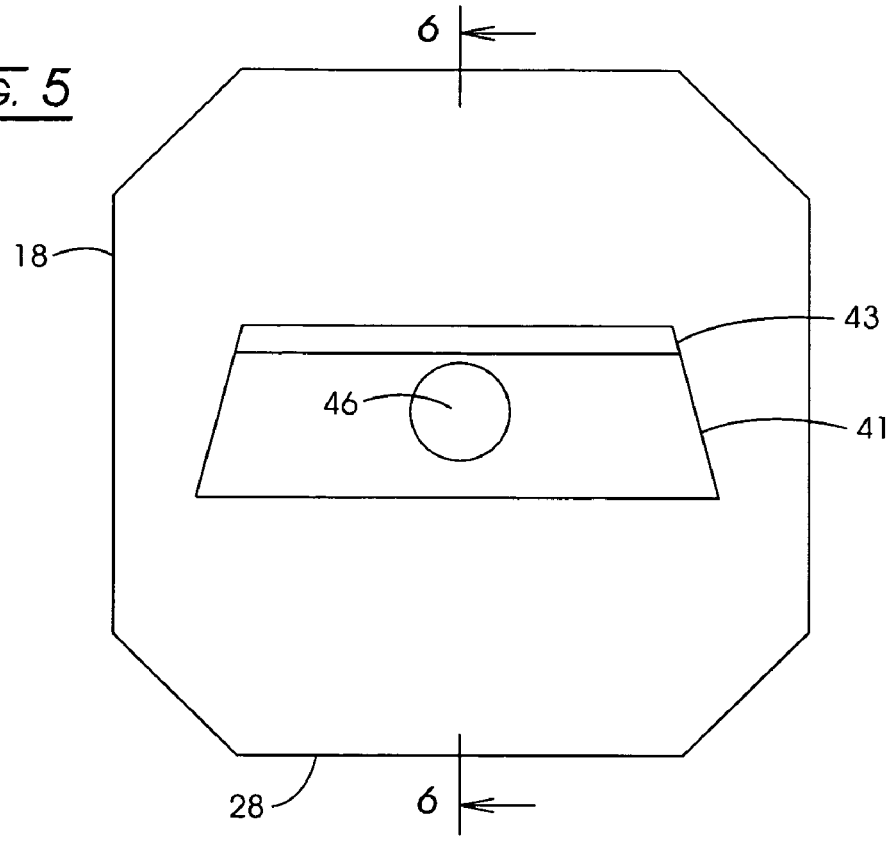
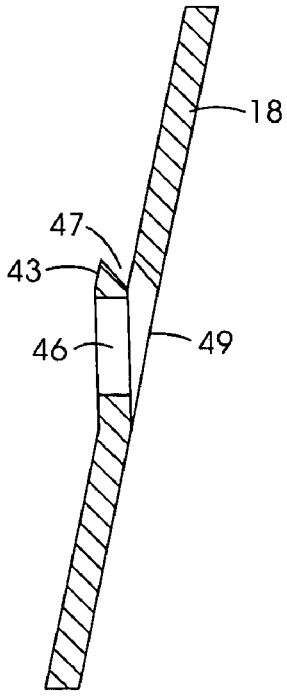
FIG. 6
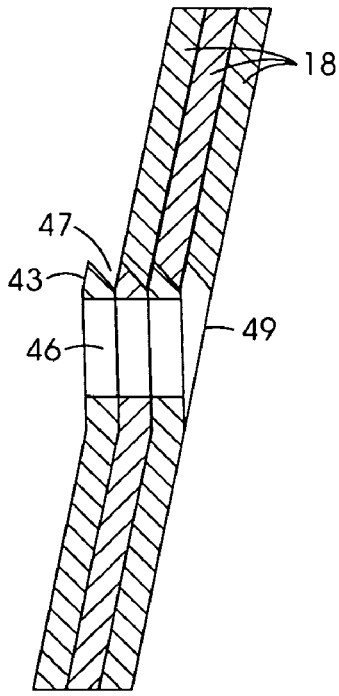
FIG. 7

FIG. 14
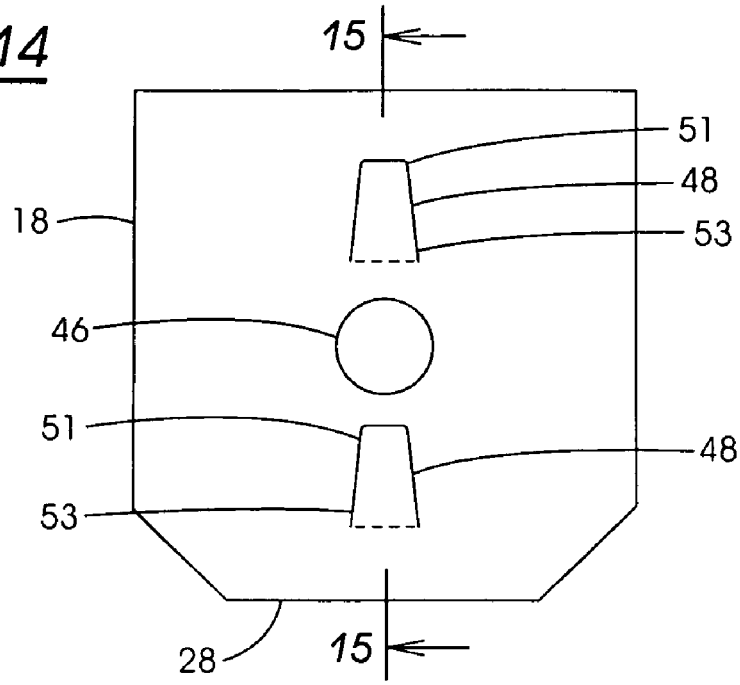
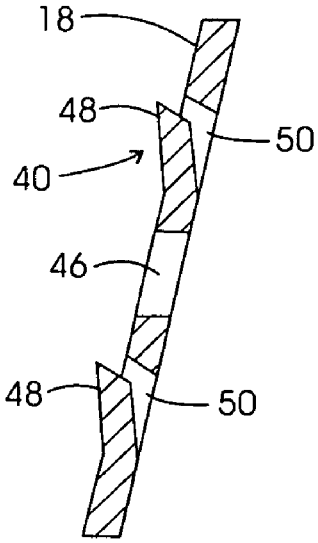
FIG. 15
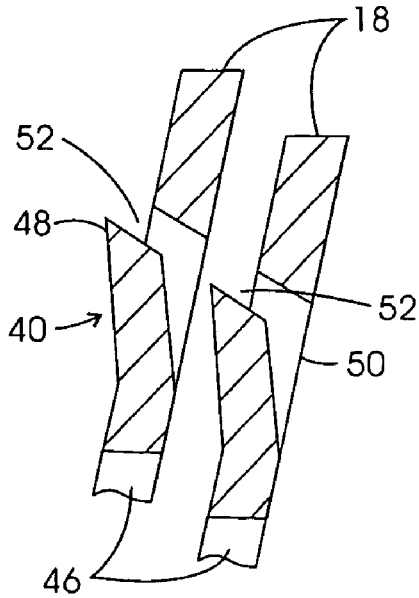
FIG. 16

FREESTANDING SELECTABLE FREE WEIGHT ASSEMBLY

CROSS-REFERENCE TO RELATED APPLICATIONS

This application claims benefit of provisional application 61/025,317, filed on Feb. 1, 2008, the disclosure of which is expressly incorporated herein by reference.

STATEMENT REGARDING FEDERALLY SPONSORED RESEARCH

Not applicable.

BACKGROUND

The disclosed apparatus relates to an improvement in the design and method of construction of free weight dumbbells that are frequently employed by individuals seeking physical benefits for therapeutic, recreational, competitive sports, or other personal reasons. More specifically, to an adjustable weight dumbbell apparatus that enables a user to have access to a plurality of differing weight sets in a single handset and that facilitates the addition or subtraction of weight from the apparatus safely and efficiently.

With the increasing focus on health and physical fitness, strength training is more popular than ever. In response to this, the market is flooded with devices that are designed to help people access the advantages of resistance training. These devices range from the tried and true free weights to complex and expensive machines all claiming advantages over everything else on the market. Despite all of the possible options, the real obstacle in resistance training remains to be an individual's actual use of the equipment, not the nature of the equipment. Additionally, those most knowledgeable in the area still consider free weights to be the gold standard as they offer the greatest range of motion in the performance any specific resistance training routine.

In the past, the use of free weight dumbbells generally offered the user to use one of two different options. The first was an adjustable dumbbell that required the physical clamping or securing of the weights to a handset via the use of a hand wrench manual locking apparatus. The other option provided was a plurality of free weight dumbbells of solid mass in a sufficient number in order to fulfill all the free weight requirements. While these and numerous other systems do accomplish the desired results, they all suffer from a number of limitations. The first of these is the manual locking system. These types of devices are cumbersome and often difficult to operate thereby adding complexity to a workout routine and lessening the probabilities of the user actually attaining their long-term goals. Additionally, these systems are prone to problems as their locking collars wear and, thus, may work loose and subsequently cause a failure of the handset to retain its weights. This often results in safety issues as this situation may allow a weight to fall off of the handset creating a dangerous falling weight that has the potential for injuring the user or damaging personal property.

The second type of free weight dumbbell described above is the plurality of free weight dumbbells of solid mass. While this is an effective and relatively safe option, in order to attain the required variability in resistance for an effective training routine the user needs a large number of different dumbbell sets. This circumstance has two distinct problems: the large number of dumbbell sets require a large storage area, and the large number of dumbbell sets represent a large investment for the user. The inconvenience of using either of the above described free weight dumbbells may—and often does—cause the user to reduce or completely abandon their workout routine.

More recently, improvements in the designs of free weight dumbbell designs have been made. While these developments have shown significant advantages in their designs, they still are encumbered by numerous disadvantages. One of these new designs requires the left and right weight plates be fastened together as a single weight to help ensure the dumbbell assembly does not lose its structural integrity. A foreseeable issue in this design is the user is required to lift and release the dumbbell from a specific opening between the parallel bars that form a "cage like" apparatus in the area from which the dumbbell is lifted during use. This design also has the added deficiency of restricting the user's ability to release the dumbbell in all positions reasonably necessary without trapping the users hand in the dumbbell, a situation that can potentially cause injury to the user.

A further problem occurs in the event the dumbbell is set down abruptly on a hard surface. This design type is more prone to damage in this circumstance, as it requires the left and right weight plates be permanently fastened together with a degree of precision that, if bumped out of square, may cause the weights to lock semi-permanently together. Also, this out of square problem also may result in problems with the use of the "cage like" base required in the design. Finally, the curling of the users wrist during an exercise routine in order to target a specific area or muscle group, may be restricted if the left to right parallel bars that run above and below the users wrist collide with the users arm.

Another design type involves a change in the above-described design of clamp apparatus employed to secure the dumbbell weights that, while possibly fulfilling the purpose of securing the weight plates to the dumbbell handle, still contains inadequacies that limits its overall effectiveness. One of these deficiencies is that regardless of the number of weights added or subtracted from the dumbbell, the overall length of the dumbbell bar remains constant. This results in a protrusion of the dumbbell bar beyond the outer most weight. Since a compact design is an important feature in dumbbell free weights, and is a significant factor in overall performance and safety to the user, protrusions beyond the weights can impede the exercise work out and cause injury to the user when the protrusions collide with the users leg, head, or other part of the body.

Another important safety concern in free weight dumbbell use and design is to facilitate accessibility to the dumbbell bar to aid the user. The person that would usually assist the dumbbell user is commonly known as a "spotter" or a "trainer". They are standing by the user as a "just in case" measure in the event of the user loosing control of the free weight, or simply to better train the user on the use of free weights. In either case, protrusions from beyond the dumbbell in use, or designs that block access to the users hands can play a significant role in increasing the risks to both the trainer, spotter, and/or the user.

A still further deficiency existing in the prior art is associated with an adjustable dumbbell apparatus that employs a tray or other containment device to retain and support the dumbbell when not in use. The problem with this design is that the dumbbell and tray are designed to fit snuggly together. This design requires a great deal of care and precision when replacing the dumbbell into the tray. Additionally, the portions of the dumbbell and tray assemblies are subject to wear leading to potential malfunctions.

Finally, the adjustable dumbbell designs on the market today all suffer from a general lack of capacity with respect to the amount of weight that can be attached to any one handset. Generally speaking, all of the adjustable dumbbell designs available on the market today are limited to an overall weight of 60 to 65 pounds. This limitation is primarily due to the nature of the design and the difficulties associated with designing an adjustable dumbbell that has a higher weight capacity. While this limitation does not necessarily impact the average user of free-weight dumbbells, it does affect the higher end of the market for those individuals that require higher resistance to attain their goals.

From the forgoing discussion, it is clear that, while the offered solutions do represent improvements in the design of free weight dumbbell apparatuses, there is still room for improvement. As a group they are still relatively expensive and have many concerns associated with their use revolving around the safety of the people that use them. The safety issues are a paramount concern as the high emotional and financial cost of injury to the user or to those nearby should be well thought out in the design of a free weight system. After all, the use of any equipment for the purpose of enhancing one's physical fitness should not come with an elevated risk of injury, a situation that negates any benefit gained from their use.

Therefore, it can be seen that it would be desirable to provide a selectable free weight dumbbell apparatus that is safe and easy to use by people of all levels of ability. Additionally, it can be seen that a selectable free weight dumbbell apparatus should be designed and built in a compact manner that allows for easy storage and use without requiring a tray or other containment apparatus to hold the dumbbell apparatus when not in use. Further, it can be seen that such a selectable free weight dumbbell apparatus should be designed and built in a manner that is simple for the user to select the desired weight and secure that weight to the apparatus in an effective and secure manner. Finally, it can also be seen that such a selectable free weight dumbbell apparatus should be designed in such a manner allows it to carry a greater amount of weight then such devices are capable of today to provide a greater degree of flexibility to individuals with more advanced training requirements.

SUMMARY

It is an advantage of the disclosed apparatus to provide a freestanding selectable free weight dumbbell apparatus that is safe to use both for the user and for those interacting with or in the vicinity of him or her.

It is an additional advantage of the disclosed apparatus to provide such a freestanding selectable free weight dumbbell apparatus that is designed and built in a compact manner that allows for easy storage and use without the need for the use of a storage tray or other containment device.

It is a further advantage of the disclosed apparatus to provide such a freestanding selectable free weight dumbbell apparatus that allows for the simple selection of the desired weight and then secures that selected weight to the apparatus in an effective and secure manner and that allows for the attachment of a greater amount of weight then was previously possible.

It is a still further advantage of the disclosed apparatus to provide such a freestanding selectable free weight dumbbell apparatus that is designed in such a manner as to allow for cost effective production and results in a product that is durable and able to withstand heavy use.

It is a still further advantage of the disclosed apparatus to provide such a freestanding selectable free weight dumbbell apparatus that is designed in such a manner as to allow for cost effective production and results in a product that is durable and able to withstand heavy use.

It is a yet further advantage of the disclosed apparatus to provide such a freestanding selectable free weight dumbbell apparatus that employs an electrical selector shaft drive engaged by the dumbbell handle assembly.

These advantages are accomplished by the design and manufacture of a freestanding selectable free weight dumbbell apparatus or so-called free weight assembly. The disclosed apparatus is generally configured having a centrally positioned dumbbell handle assembly. The dumbbell handle assembly is a horizontally oriented cylindrical component that provides the base upon which the remaining components of the disclosed apparatus are positioned. Depending on the length of the handle assembly, the disclosed apparatus may be termed a dumbbell or a barbell weight set.

The most apparent of these other components are the two weight plate sets. The weight plate sets are the components of the disclosed apparatus that provide the necessary resistance allowing it to function as a weight-training device. The two weight sets are each positioned on the opposite outer ends of the dumbbell handle assembly. This is accomplished in such a manner so that the central portion of the dumbbell handle assembly is exposed allowing the user to grasp the centrally located grip to make use of the disclosed apparatus in the manner for which it was designed.

The weight sets themselves are made up of a plurality of components, the principle of which are the inner weight plates. The inner weight plates form the bulk of the resistance of the disclosed apparatus and are comprised of a plurality of individual weight plates made of a metallic or other similarly dense material that are formed in a predetermined weight and shape. Additionally, the individual inner weight plates are designed to lock both together and to the other components of the weight plate sets. The mechanism of this locking function and the importance of it to the operation of the disclosed apparatus will be discussed in greater detail below.

The other components making up the weight plate sets are the inner and outer plate housing wedges. The inner and outer plate housing wedges form the inner and outer surfaces of the weight plate sets and are integral to the plate selection capability of the disclosed apparatus. As seen from a side elevation view, the inner and outer plate housing wedges are shaped as right triangles having the hypotenuse of each facing inwards towards the contained inner weight plates. Additionally, when properly installed on the dumbbell handset, the 90-degree angle of the inner plate housing wedge is oriented, with respect to the lateral plane defined by the centerline of the dumbbell handset, opposite to the 90-degree angle of the outer plate housing wedge.

This configuration then serves, along with some design characteristic of the inner weight plate that will be discussed in greater detail below, to hold the inner weight plates at an angle with respect to the dumbbell handle assembly. The inner plate housing wedges also provide the point of attachment for the selector knob assemblies. The selector knob assemblies are the components of the disclosed apparatus that allow the user to select the desired number of inner weight plates to achieve the needed amount of resistance for the specific training exercise being performed. The selector knob assemblies are made up of selector knobs, selector rods, and pinions. These components then are operated to move the selector shafts in and out of the handle interior to engage the desired number of inner weight plates.

The selector knobs are relatively short cylindrical objects that are located at the upper and central portion of the inner plate housing wedges. In this location, the selector knobs sit within the knob recesses and are rotationally fixed in this position by the use of the selector rods. The selector rods then extend down through the inner plate housing wedges and terminate at the point that they are fixedly attached to the pinions. The pinions in turn drive the selector shafts. The selector knob assemblies also are constructed in a manner that allows the selector knobs to be depressed when not in use and to pop-up when needed to adjust the disclosed apparatus's resistance. This provides a design that, not only reduces the probabilities of the selector knobs becoming damaged in use, but also increases the overall aesthetic properties of the disclosed apparatus. To accomplished this, the knob recesses are cut relatively deep into the inner plate housing wedges. This manner of construction allows the selector knobs to be mounted so that their upper surfaces are flush with the upper surfaces of the inner plate housing wedges when the selector knobs are not in use. Additionally, the selector knob assemblies are constructed in a manner so that they can pop up to extend above the inner plate housing wedges when it is necessary to adjust the number of selected inner weight plates. Conversely, the selector knobs can be depressed when not needed thereby accomplishing the desired outcome.

The selector knobs also engage the spring-loaded detent assemblies. The spring loaded detent assemblies will be discussed in greater detail below, but, in short, they are the components of the disclosed apparatus that are employed to positively identify the number of inner weight plates that are engaged by the selector shafts. This is accomplished by mounting the spring-loaded detent assembly within the knob recess in a manner so that its outer end extends into the knob recess.

The outer cylindrical surface of the selector knobs are equipped with a plurality of detent locking depressions the position of which coincide with a specific position of the selector shafts with respect to the individual inner weight plates. Thus, the selector knobs not only allow for the manipulation of the selector shafts, but also provide a means of positively identifying the amount of resistance of the disclosed apparatus as a whole.

The inner weight plates and the inner and outer plate housing wedges are also equipped with plate locking mechanisms. The plate locking mechanisms function to lock two adjoining inner weight plates together or an inner weight plate to either the inner or outer weight plate housing wedges in conjunction with the position of the selector shafts. This is accomplished by the design of the components of the plate locking mechanisms and the diagonal orientation of the inner weight plates and inner and outer plate housing wedges when engaged by the selector shafts. The design and operation of these components of the disclosed apparatus will be described in greater detail below.

It also should be noted that the inner weight plates and the inner and outer plate housing wedges could be designed and built having a profile of a nearly unlimited shape. For purposes of simplicity, this discussion and the accompanying illustrations will only deal with these components being of a square, rectangular, or octagonal shape. However, this is not intended to limit the design to these shapes. Rather, it is intended that this discussion cover all possible shapes of the inner weight plates and inner and outer plate housing wedges.

A key to the operation of the plate locking mechanisms is that, when the outer plate housing wedges and one or more of the inner weight plates are not engaged by the selector shafts, they will remain locked together but will not stay attached to the dumbbell handle assembly. Thus, when a user configures the disclosed apparatus in this manner, the outer plate housing wedges and any disengaged inner weight plates will remain locked together on the surface that the disclosed apparatus had rested prior to its use. When the desired training exercise has been completed, the user simply replaces the dumbbell handle assembly to the original position between the two unused weight sets. The operation of the plate locking mechanisms then serves to automatically align the unused weight sets with the dumbbell handle assembly. This, then, allows for the selection of more or less of the inner weight plates by the use of the selector knobs and the selector shafts as described.

The articulating operation of the selector shafts within dumbbell handle assembly is facilitated by the use of the pinion located on the terminal end of the selector knob rod and the selector shaft rack located along the side of the selector shaft. Each of these components are equipped with a matching set of teeth that, when properly positioned, engage one another. Thus, when rotational force is applied by the user to the selector knob, the pinion is rotationally driven in an equal manner. The engagement of the pinion to the selector shaft then transfers this rotational force to lateral force through the engaged pinion and rack teeth. The resulting lateral movement of the selector shafts into and out of the selector shaft holes provides the mechanism by which the user can alter the overall resistance of the disclosed apparatus through the positioning of the selector shafts with respect to the inner weight plates.

The disclosed apparatus also is capable of being fitted with selector shafts of varying lengths. This feature of the disclosed apparatus allows the owner to limit the amount of weight that can be fitted to the dumbbell handle assembly. This ability is very beneficial in situations, such as schools or public gyms, where safety and liability concerns dictate that users are unable to equip the disclosed apparatus with more weight then they can safety handle. This ability is facilitated through the use of short selector shafts that can engage only a limited number of inner weight plates between the inner and outer weight plate housing wedges.

As previously stated, the knob recesses of the inner plate housing wedges are equipped with spring-loaded detent assemblies. The spring-loaded detent assemblies are the components of the disclosed apparatus that are employed for the positive selection of the desired number of the inner weight plates. The spring-loaded detent assemblies operate in conjunction with the plurality of circularly oriented detent locking depressions located on the outer surface of the selector knobs. The detent locking depressions are placed on the surface of the selector knobs in a location so that they can easily come into contact with the outer end of the detent locking assemblies that extend slightly out of the vertical surface of the knob recesses. The outer ends of the spring-loaded detent assemblies are equipped with a detent ball that extends slightly out of their lower surfaces. This configuration, then, allows the detent balls to engage the selector knob's detent locking depressions.

The spring-loaded detent assemblies come into play as the plate selector knobs are rotated to select the desired number of weight plates. During this operation, the detent locking depressions rotate around a specified path over the spring-loaded detent assemblies. At differing intervals along this path, the detent ball engages one of the detent locking depressions, thereby locking the weight selector knob in a specific location. The location of the detent locking depressions corresponds to an exact lateral position of the selector shafts. Thus, the spring-loaded detent assembly provides the use of the disclosed apparatus to ensure and monitor the exact number of the weight plates that are selected for the training exercise.

An additional embodiment of the disclosed apparatus has been contemplated that employs electrical components to position the selector shafts to engage the desired number of inner weight plates. While this may be accomplished by any number of mechanisms, two primary possible configurations will be described. However, the confinement of the following discussion to these specific mechanisms is purely for the purposes of illustration and should not be construed as limiting the scope of the disclosed apparatus.

The first of the two configurations employs the use of two independent selector shaft drive mechanisms, one each located in the two inner plate housing wedges of the dumbbell handle assembly. In this configuration, each inner plate housing wedge is equipped with bipolar stepper motor, a battery pack, a control panel, and an integrated circuit board. These components then operate together to control the position of the selector shafts with respect to the inner weight plates.

The control panel is mounted on the upper surface of the inner plate housing wedges in a manner so that they are easily accessible to the user. The control panel is connected to the bipolar stepper motor through the integrated circuit board. This configuration provides the means by which the position of the selector shafts is controlled through the bipolar stepper motor. The bipolar stepper motor, then, provides the rotational force necessary to rotate the pinion (positioned in the same manner as described above for the previous embodiments of the disclosed apparatus), which in turn drives the selector shafts through its interaction with the selector shaft rack. The use of this mechanism allows the user to select the desired amount of resistance offered by the disclosed apparatus by simply by making the necessary selections on the control panels.

The second configuration of the disclosed apparatus employing electrically powered weight selection capabilities uses a single linear actuator stepper motor that is centrally positioned within the handle. In this manner of construction, the linear actuator stepper motor is directly connected to each of the selector shafts by use of the actuator drive screws. The two actuator drive screws extend outward from either side of the linear actuator stepper motor and are equipped with an outer surface comprising of right handed threads on one side and left hand threads on the other. The use of the opposite thread orientations ensures that while the linear actuator stepper motor rotates the actuator drive screw, the threaded attachment of the two selector shafts on either side will be driven in opposite directions. Thus, the single action rotation of the linear actuator stepper motor is employed to move the two selector shafts in and out relative to the remaining components of the disclosed apparatus thereby allowing for the selection of the desired weight.

The linear actuator stepper motor is controlled by the use of a single control panel located on the upper surface of one of the inner plate housing wedges of the dumbbell handle assembly. The control panel then is electrically connected to the linear actuator stepper motor through an integrated circuit board. Additionally, the wires establishing this connection run from the integrated circuit board to the linear actuator stepper motor through a keyway groove located in the lower surface of one of the selector shafts. This manner of construction allows a user to control the operation of both the selector shafts through the simple operation of the single control panel providing the simplest possible mechanism of selecting the desired amount of weight when using the disclosed apparatus.

The disclosed adjustable weight set, then, includes an annular hand graspable handle assembly having a pair of rod apertures. A pair of rack shafts are disposed within the handle assembly where each rack shaft has a series of grooves disposed along its length. A pair of spaced apart weight assemblies are disposed about the handle assembly to reveal a centrally disposed hand grip portion of the handle assembly. Each weight assembly in turn includes a inner wedge assembly and a outer wedge assembly in spaced apart relationship. Each wedge assembly has an inner slanted face that carries the handle assembly. At least two slanted weight plates are disposed between each of the outer and inner wedge assemblies. Each of the slanted weight plates has a trapezoidally-shaped tang extending to the side and adjacent to a locking slot in the weight plate. Each adjacent weight plate interlocks by a tang of one weight plate inserted into the locking slot of an adjacent weight plate. There also is a centrally disposed hole in each weight plate configured to receive the handle assembly. A knob assembly is carried by each inner wedge assembly and includes a hand rotatable, detented knob accessible by a user where the know carriers a series of detent depressions thereabout. Each knob detent depression corresponds to one slant weight plate and each detent corresponds to 1 weight plate. The knob assembly also includes a rod having an upper end affixed to the knob and a lower end extending through the handle assembly rod aperture and affixed to a rotatable notched pinion. The pinion notches mate with the rack shaft grooves where rotating the knob causes the pinion to rotate which in turn moves the rack shaft to move inside the handle assembly underneath the slated weight plates, whereby rotating each knob causes each rack shaft to move back and forth within the handle assembly to support a defined number of slanted weight plates for use by the user.

For a better understanding of the disclosed apparatus, reference should be made to the drawings and the description in which there are illustrated and described preferred embodiments of the disclosed apparatus.

BRIEF DESCRIPTION OF THE DRAWINGS

For a fuller understanding of the nature and advantages of the present (device) (process) (apparatus), reference should be had to the following detailed description taken in connection with the accompanying drawings, in which:

FIG. 5 is a front elevation view of the plate component of the disclosed apparatus illustrating its manner of construction.

FIG. 6 is a side elevation cut-away view of the plate component of the disclosed apparatus of FIG. 5 taken along LINE 4.

FIG. 7 is a side elevation cut-away view of two of the plate components of FIG. 5 illustrating the manner by which they fit together and the mechanisms employed to lock them in their respective positions.

FIG. 14 is a front elevation view of an alternative embodiment of the plate component of the disclosed apparatus illustrating its manner of construction.

FIG. 15 is a side elevation cut-away view of an alternative embodiment of the plate component of the disclosed apparatus of FIG. 14 taken along line 6.

FIG. 16 is a side elevation cut-away view of two of the alternative embodiments of the plate component of FIG. 14 and taken along line 6 illustrating the manner by which they fit

Figure 1:
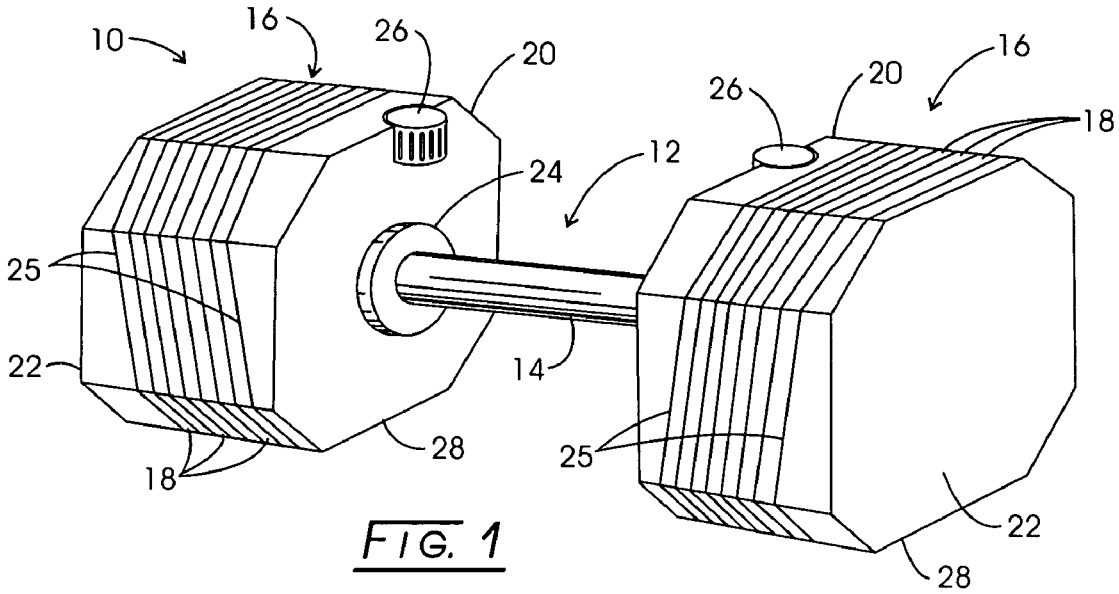
FIG. 1 is a perspective view of the present illustrating its manner of construction and detailing the orientation of its major components.
Figure 2:
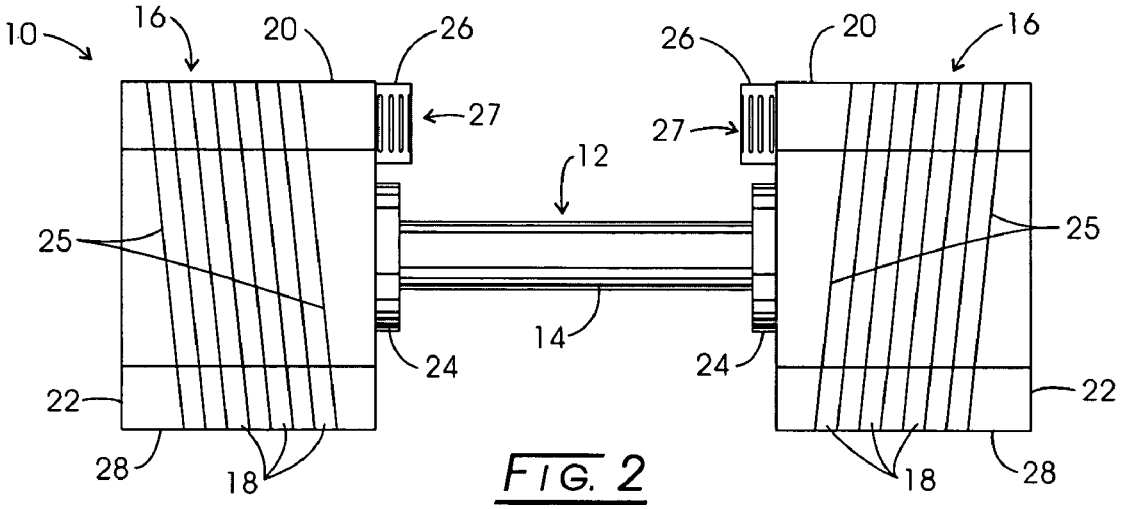
FIG. 2 is a side elevation view of the disclosed apparatus of FIG. 1.
Figure 3:
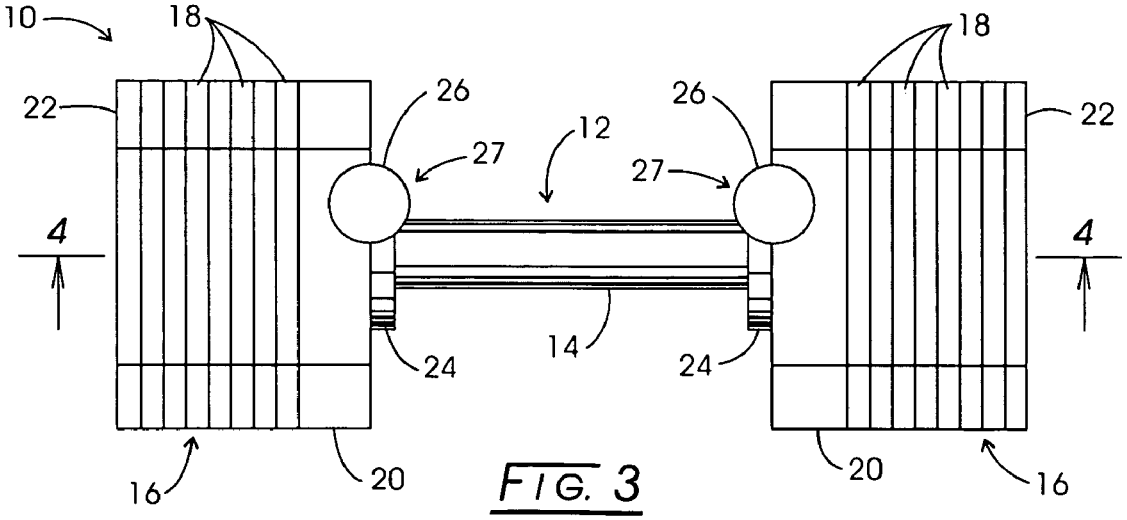
FIG. 3 is a top elevation view of the disclosed apparatus of FIG. 1.

The drawings will be described in greater detail below.

DETAILED DESCRIPTION

Referring now to the drawings, and more specifically to FIGS. 1, 2, 3, and 4, a freestanding selectable free weight dumbbell apparatus, 10, is generally made up of a centrally positioned dumbbell handle assembly, 12, and a pair of weight plate sets, 16. Dumbbell handle 12 assembly is a horizontally oriented cylindrical component of the disclosed apparatus the visible portion of which comprises a grip, 14. Grip 14 is the central portion of dumbbell handle assembly 12 located between two handle collars, 24. Handle collars 24 define the inner limits of weight plate sets 16. Grip 14 allows the user to grasp and manipulate the disclosed apparatus for the purposes of performing the weight training exercises that are central to the disclosed apparatus.

Apart from dumbbell handle assembly 12; the other major components of the disclosed apparatus are two weight plate sets, 16. Weight plate sets 16 are the components of the disclosed apparatus that provide the bulk of the necessary resistance allowing it to function as a weight training device. Weight sets 16, two in number, are each positioned on the opposite outer ends of dumbbell handle assembly 12. This configuration produces the classic shape that is well known as a dumbbell.

Weight sets 16 themselves are made up of a plurality of components, the principle of which are inner weight plates, 18. Inner weight plates 18 are comprised of a plurality of individual plates of identical design and generally oriented in parallel sequence between inner and outer plate housing wedges, 20 and 22, respectively. Inner weight plates 18 are made of a metallic or other similarly dense material that are formed in a predetermined weight and shape. Additionally, individual inner weight plates 18 are designed to lock both together in the parallel sequence and to the other components of weight plate sets 16. The mechanism of this locking function and the importance of it to the operation of the disclosed apparatus will be discussed in greater detail below.

The other primary components making up weight plate sets 16 are inner and outer plate housing wedges 20 and 22. Inner and outer plate housing wedges 20 and 22 form the inner and outer surfaces of weight plate sets 16 and are integral to the plate selection capability of the disclosed apparatus. As seen from a side elevation view, inner and outer plate housing wedges 20 and 22 are shaped as right triangles having the hypotenuse of each facing inwards towards contained inner weight plates 18. Additionally, when properly installed on dumbbell handset 12, the 90-degree angle of inner plate housing wedge 20 is oriented, with respect to the lateral plane defined by the centerline of dumbbell handset 12, opposite to the 90-degree angle of outer plate housing wedge 22. This configuration then serves, along with some design characteristic of inner weight plates 18 that will be discussed in greater detail below, to hold inner weight plates 16 at an angle with respect to dumbbell handle assembly 12.

The angle created by hypotenuse, 25, of inner and outer plate housing wedges 20 and 22, is transferred to inner weight plates 18 with respect to dumbbell handle assembly 12. Additionally, hypotenuse angle 25, when taken from the bottom of weight plate sets 16 to the top, angles out towards the edges of the disclosed apparatus. This aspect of the design of weight plate sets 16 is important to the operation of the disclosed apparatus, as it plays a role in the containment of individual weight plates 18 when they are not attached to dumbbell handle assembly 12.

Figure 4:
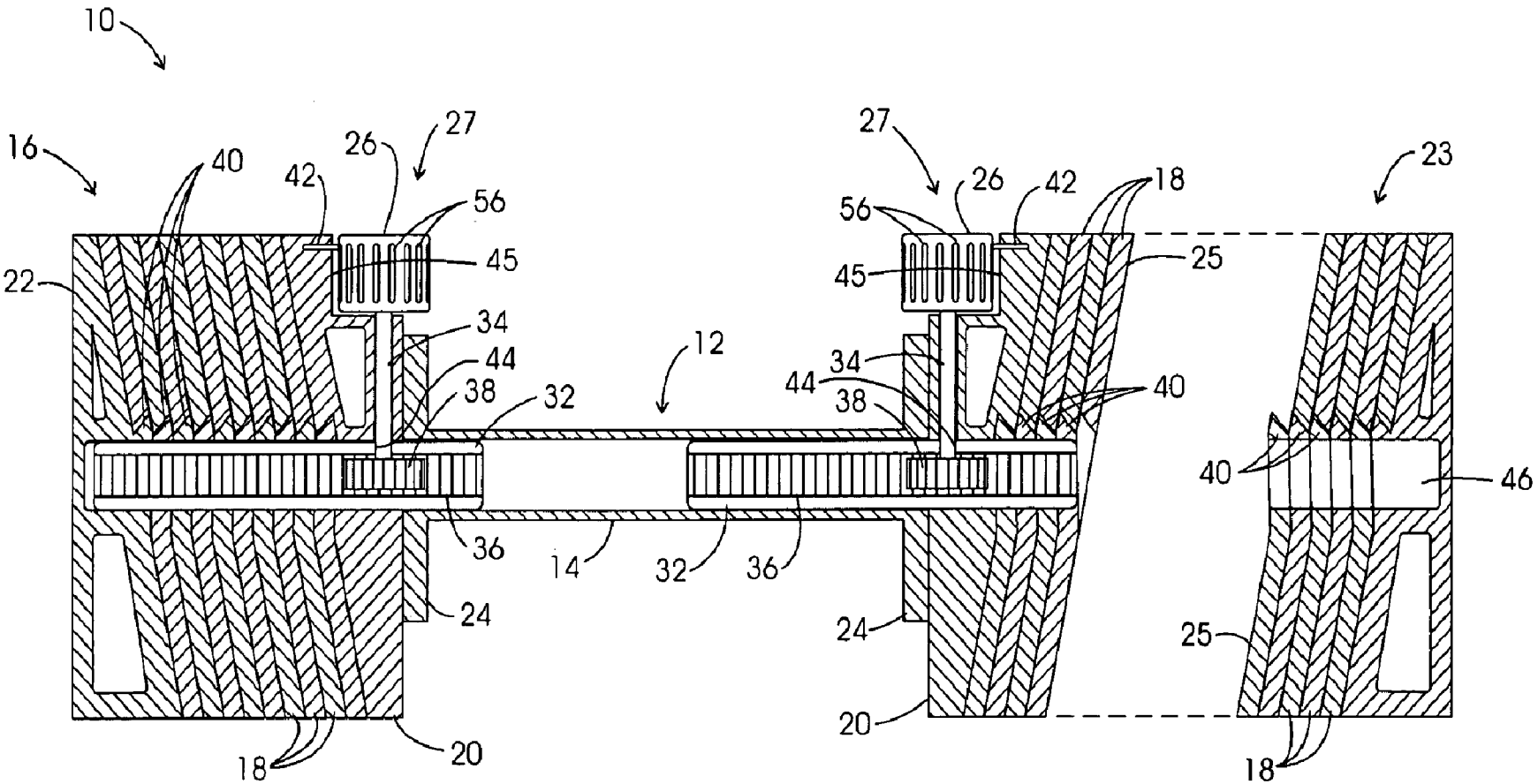
FIG. 4 is a side elevation cross sectional view of the disclosed apparatus of FIG. 3 taken along line 3.

The detachment of some of inner weight plates 18 for the purpose of adjusting the resistance offered by the disclosed apparatus results in a residual weight set, 23, detailed in FIG. 4. Residual weight set 23 is made up of outer plate housing wedge 22 and one or more inner weight plates 18 and is the portion of weight plate sets 16 that is not engaged by selector shafts, 32. Residual weight set 23 remains behind when the used portion of the disclosed apparatus is employed simply by resting on support surface 28 formed on the lower surface of weight plate sets 16.

The role of hypotenuse angle 25 comes into play with respect to residual weight sets 23. The resulting angle created in unused inner weight plate 18 ensures that they rest against the inner surface of outer plate housing wedge 22. This configuration, along with plate locking mechanisms, 40 (again, to be discussed below), ensure that inner weight plates 18 that are used will remain in the desired location as part of residual weight sets 23.

The manner of construction of inner weight plates 18 and their associated components are further illustrated in FIGS. 4, 5, 6, and 7. As previously stated, inner weight plates 18 and inner and outer plate housing wedges 20 and 22 are equipped with plate locking mechanisms 40. Plate locking mechanisms 40 function to lock two adjoining inner weight plates 18 together or inner weight plate 18 to either inner or outer weight plate housing wedges 20 or 22 in conjunction with the position of selector shafts 32. This is accomplished by the design of the components of plate locking mechanisms 40 and the diagonal orientation of inner weight plates 18 as a result of hypotenuse angle 25 of inner and outer plate housing wedges 20 and 22.

The plate locking mechanisms are primarily made up of central locking tang, 41. Central locking tang 41 is actually a portion of inner weight plate 18 that is formed by making a three-sided cut through its body. Once this is accomplished, the area inside of the cut is bent outward to a specific angle to form central locking tang 41. The open space left in inner weight plate 18 then forms a central locking slot, 49. Additionally, the cut is made at an angle having the edge defining its lower surface being significantly longer that that forming its upper surface.

The upper surface of central locking tang 41 also is specifically designed to facilitate the locking and unlocking of inner weight plates 18 during the use of the disclosed apparatus. In this, the upper surface of central locking tang 41 is equipped with an angled flush face, 43, and an oppositely oriented locking edge, 47. Flush edge 43 is constructed with a specific angle so that this portion of central looking tang 41 will not interfere with the surface of adjoining inner weight plate 18. Locking edge 47, on the other hand, is designed to engage and lock into the upper portion of central locking slot 49 located on the other side of relevant inner weight plate 18. This method of construction allows for the necessary positioning of central locking tang 41 with respect to adjoining central locking slots 43 while providing a mechanism that allows for the placement of a plurality of inner weight plates 18 flush up against one another as required the disclosed apparatus.

Another design feature of central locking tangs 41 is the positioning of selector shaft holes 46 at their center. Selector shaft holes 46 allow for the passage of selector shafts 32 in and out of inner weight plates 18 to allow the weight selection operation that is central to the operation of the disclosed apparatus. Additionally, the interaction of selector shafts 32 and selector shaft holes 46 aids plate locking mechanisms 40 in securing inner weight plates 18 to dumbbell handle assembly 12. The location of these two related components in close proximity to one another aids in their operational characteristics, thereby improving the operation of the disclosed apparatus.

The locking and unlocking of inner weight plates 18, thus, is accomplished by first placing selector rod 32 (the operation of which will be fully discussed below). With this step done, the user then either lifts dumbbell handle assembly 12 and attached inner weight plates 18 or replaces the same back into waiting residual weight sets 23. This motion generally results in a vertical interaction between two inner weight plates 18 involved. In the decoupling action, the lifting motion allows central locking tang 41 to slide out of its connection with central locking slot 49 on adjacent inner weight plate 18. Conversely, the user simply reverses this process. During this operation, locking edge 47 of one inner weight plate's 18 central locking tang 41 will engage central locking slot 49 of adjoining inner weight plate 18. As two inner weight plates 18 slide together, the described engagement of locking edge 47 will guide them into the proper locked orientation.

An important aspect of locking mechanism 40 that is not illustrated is that it will operate effectively whether the narrow end of central locking tang and slots, 41 and 49, are pointed in an upward (as illustrated) or downward orientation. In either case, the function and interaction of all the components is the same.

It also must be noted that inner weight plates 18 and inner and outer plate housing wedges 20 and 22 can be designed and built having a profile (with reference to a front elevation view) of a nearly unlimited shape. However, for purposes of simplicity and illustration, this discussion and the accompanying illustrations will only deal with these components being of an octagonal, square, or rectangular shape. This is not intended to limit the design of these components to these shapes, but rather, it is intended that this discussion cover all possible shapes of inner weight plates 18 and inner and outer plate housing wedges 20 and 22.

Inner plate housing wedges 20 also provide the point of attachment for selector knob assemblies 27, the manner of construction of which is further illustrated in FIGS. 4, 10, 11, and 12. Selector knob assemblies 27 are the components of the disclosed apparatus that allow the user to select the desired number of inner weight plates 18 to achieve the desired amount of resistance for the specific training exercise being performed. Selector knob assemblies 27 are made up of plate selector knobs, 26, selector rods, 34, and pinions, 38. These components then are operated to move selector shafts 32 in and out of handle interior 30 to engage the desired number of inner weight plates 18.

Plate selector knobs 26 are relatively short cylindrical objects that are located at the upper and central portion of inner plate housing wedges 20. In this location, plate selector knobs 26 sit within knob recesses, 45, located in the upper central portion of inner plate housing wedge 20. Knob recesses 45 are simply depressions formed into inner plate housing wedge 20 that allow for the positioning of plate selector knobs 26 in a less obtrusive manner and in a location that allows for the operation of a spring-loaded detent assembly, 42

Plate selector knobs 26 are rotationally fixed within knob recesses 45 by the use of selector rods 34. Selector rods 34 are relatively long narrow cylindrical objects that extend down through inner plate housing wedges 20, into apertures 44 in the selector shafts 32 and terminate at the point that is adjacent to the central horizontal line of dumbbell handle assembly 12. These ends of selector rods 34 are fitted with pinions 38. Pinions 38 are cylindrical gears and are employed to articulate selector shafts 32 in and out of handle interior 32.

Plate selector knobs 26 also engage spring-loaded detent assemblies 42. Spring loaded detent assemblies 42 will be discussed in greater detail below, but, in short, they are the components of the disclosed apparatus that are employed to positively identify the number of inner weight plates 18 that are engaged by selector shafts 32. This is accomplished by mounting spring-loaded detent assembly 32 within knob recess 45 in a manner so that its outer end extends into knob recess 45. Additionally, the outer cylindrical surface of plate selector knobs 26 are equipped with a plurality of detent locking depressions, 56, the position of which coincide with a specific position of selector shafts 32 with respect to individual inner weight plates 18. Thus, plate selector knobs 26 not only allow for the direct manipulation of selector shafts 32, but also provide a means of positively identifying the amount of resistance of the disclosed apparatus as a whole.

Figure 8:
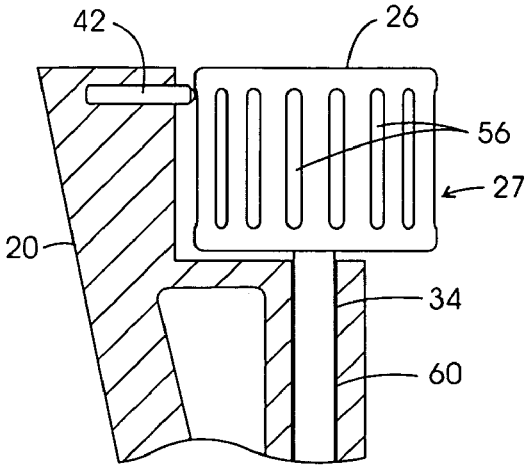
FIG. 8 is a side elevation cut-away detailed view the selector knob component of the disclosed apparatus illustrating its manner of construction and the relative positioning of the detent assembly.
Figure 9:
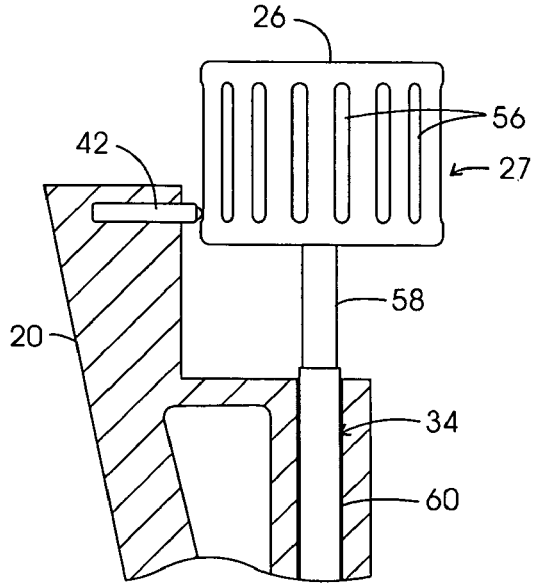
FIG. 9 is a side elevation cut-away view of the selector illustrates the relative position of the selector knob when extended for use.
Figure 10:
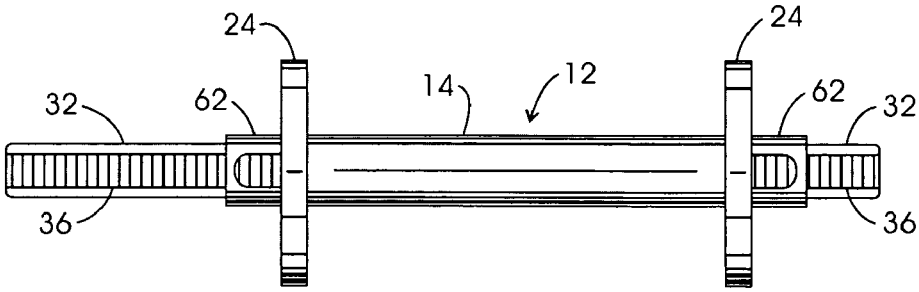
FIG. 10 is a top elevation view of the handset and selector shaft components of the disclosed apparatus illustrating their general configuration and the difference between the short and long selector shafts.
Figure 10A:
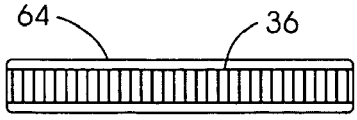
Figure 10B:
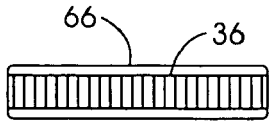

The construction of selector knob assemblies 27 and their related components is further illustrated in FIGS. 8 and 9. The method of construction of these components of the disclosed apparatus employs depressible selector knobs 26 and knob recesses 45 that are relatively deep in relation to inner plate housing wedges 20. Selector knobs 26 are equipped with detent locking depressions, 56, allowing for the engagement of detent balls, 74, at all times while the selector knobs move up and down within knob recesses 45.

This manner of design allow selector knobs 26 to be mounted so that their upper surfaces are flush with the upper surfaces of inner plate housing wedges 20 when are not in use.

Additionally, selector knobs 26 are designed so that they can pop up to extend above inner plate housing wedges 20 when it is necessary to adjust the number of selected inner weight plates 18. This generally is accomplished through the use of selector rod 34 having an inner selector rod, 58, and an outer selector rod, 60, that are connected to one another through the use of a popup spring mechanism (not illustrated). This manner of construction provides a cleaner profile to the disclosed apparatus and makes it less likely that extending selector knobs 26 will come into contact with outside objects.

As detailed in FIG. 4, the articulating operation of selector shafts 32 within dumbbell handle assembly 12 is facilitated by the use of pinion 38 located on the terminal end of selector rod 34 and selector shaft rack 36 built into the side of selector shaft 32. In this manner of construction, pinion 38 is positioned in a pinion access notch, 62, of dumbbell handle assembly 12 allowing for the interaction of pinions 38 and selector shafts 32. This manner of construction thereby facilitates the articulation of selector shafts 32.

Figure 11:
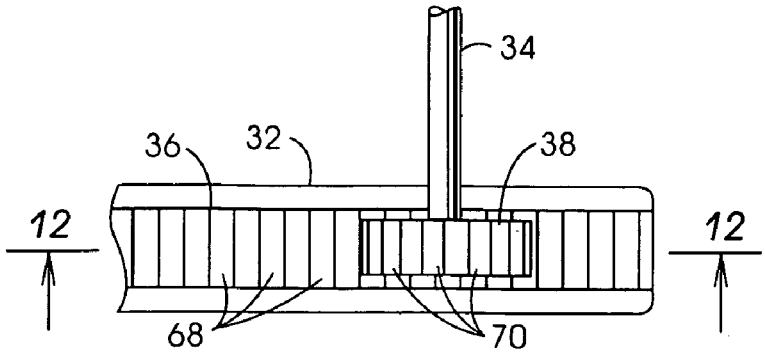
FIG. 11 is a top elevation view of the selector shaft and pinion components of the disclosed apparatus illustrating their orientation with respect to one another.
Figure 12:
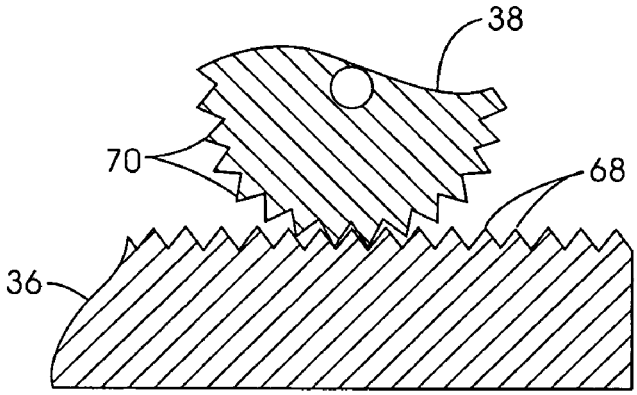
FIG. 12 is a side elevation cut-away view of the selector shaft and pinion components of the disclosed apparatus of FIG. 11 and taken along line 5.

Pinions 38 and selector shaft rack 36 are equipped with rack and pinion teeth, 68 and 70, that engage one another when pinions 38 are properly positioned. This relationship is illustrated in FIGS. 11 and 12. The manner of construction of these components ensures that when user applies rotational force to plate selector knob 26, pinion 36 is in turn rotationally driven in an equal manner. The above-described engagement of pinion 36 to selector shaft 32 transfers this rotational force to a lateral force through rack and pinion teeth 68 and 70. The resulting lateral movement of selector shafts 32 then allows the user to position selector shafts 32 relative to inner weight plates 18.

The disclosed apparatus also is capable of being fitted with selector shafts 32 of varying lengths. This ability is detailed in FIG. 10 that illustrates two possible alternate selector shafts 32, long and short selector shafts, 64 and 66. The purpose of this feature of the disclosed apparatus is to allow the owner to limit the amount of weight that can be fitted to dumbbell handle assembly 12. This is beneficial in certain situations, such as schools or public gyms, where safety and liability concerns dictate that users are unable to equip the disclosed apparatus with more weight then they can safety handle. The use of short selector shafts 66 ensures that dumbbell handle assembly 12 be capable of only engaging a limited number of inner weight plates 18 thereby limiting the total weight of the disclosed apparatus.

The changing from long selector shafts 64 to short selector shafts 66 is facilitated by the design of the components involved. The user simply rotates plate selector knob 26 in the direction that forces long selector shaft 64 out of dumbbell handle assembly 12. Since rack teeth 68 extend all the way to the end of selector shaft 32, it will continue out until it is no longer engaged to pinion 38. At this point, long selector shaft 64 can simply be removed and short selector shaft 66 installed by reversing this process. Thus, the use of long and short selector shafts 64 and 66 provides the disclosed apparatus with a degree of flexibility that was unattainable in the past.

Figure 13:
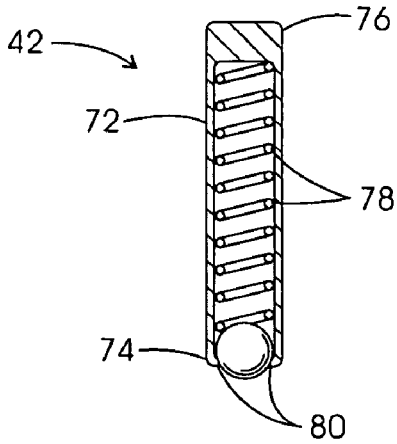
FIG. 13 is a side elevation cut-away view of the detent assembly component of the disclosed apparatus illustrating its general manner of construction.
Figure 17:
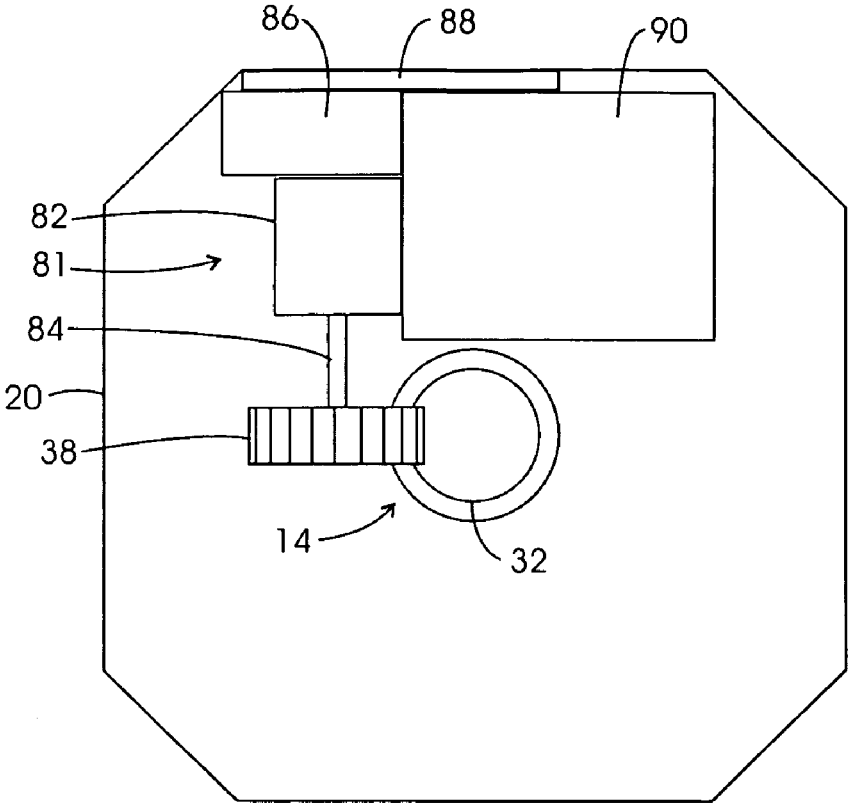
FIG. 17 is a side elevation view of the internal components of the inner plate housing wedge of an alternative embodiment of the disclosed apparatus that employs the use of electric motors to control the position of the selector shafts.
Figure 18:
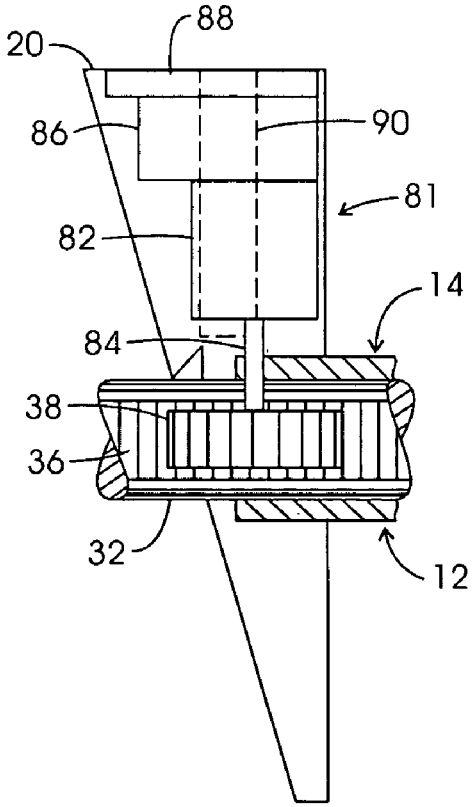
FIG. 18 is a front elevation view of the internal components of the inner plate housing wedge of an alternative embodiment of the disclosed apparatus of FIG. 17.
Figure 19:
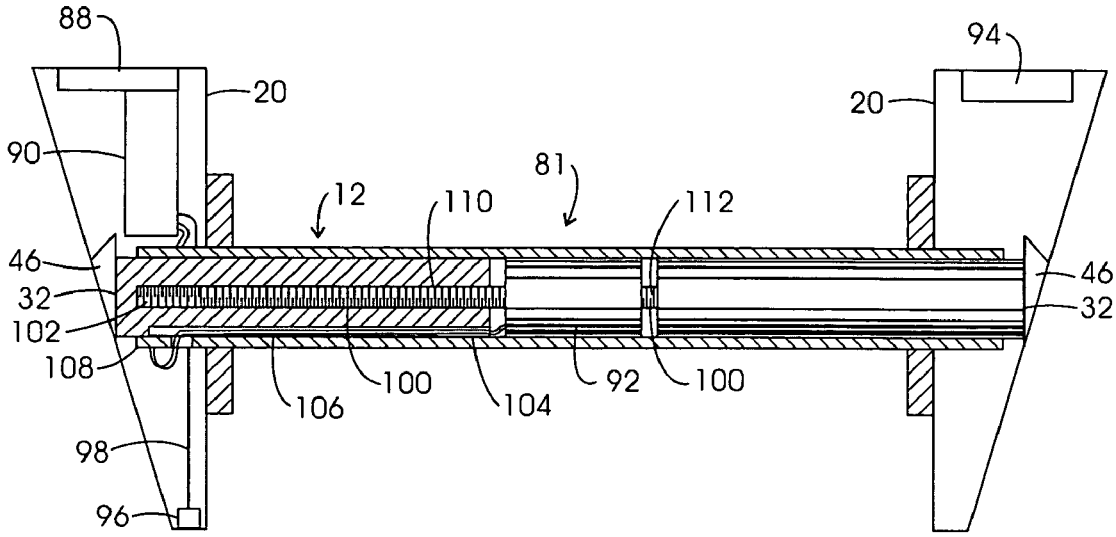
FIG. 19 is a front elevation view of a still further embodiment of the disclosed apparatus illustrating the use of a single linear actuator stepper motor to control the position of the selector shafts.
Figure 20:
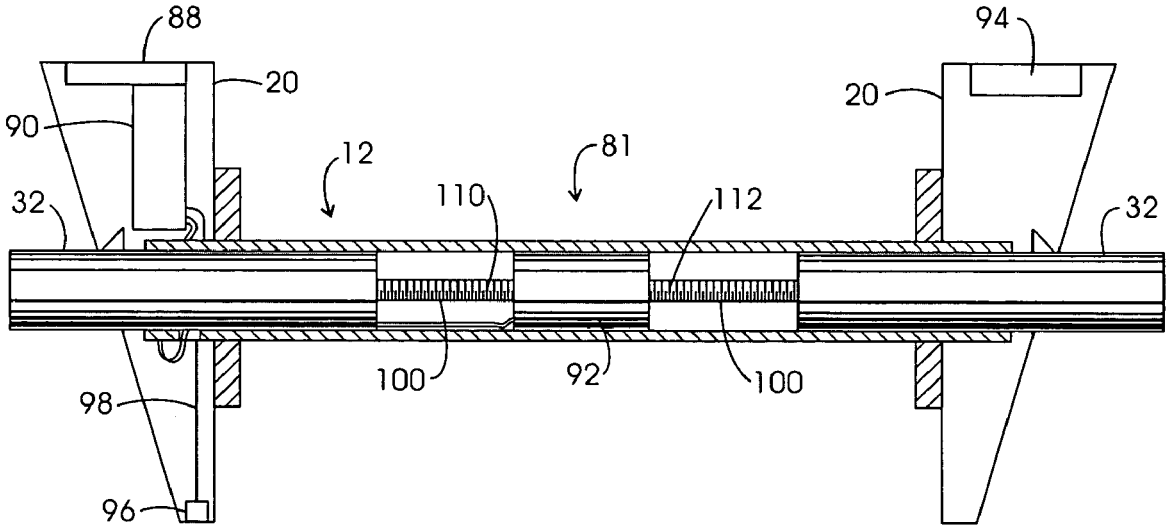
FIG. 20 is a front elevation view of the still further embodiment of the disclosed apparatus of FIG. 19.

As previously stated, knob recesses 45 of the inner plate housing wedges are equipped with spring-loaded detent assemblies 42, the manner of construction of which is further illustrated in FIG. 13. Spring-loaded detent assemblies 42 are the components of the disclosed apparatus that are employed for the positive selection of the desired number of inner weight plates 18. Spring-loaded detent assemblies 42 operate in conjunction with the plurality of circularly oriented detent locking depressions, 56, located on the outer surface of selector knobs 26, as previously described. Detent locking depressions 56 are placed in locations so that they can easily come into contact with the outer end of detent locking assemblies 42 that in turn extend slightly out of the vertical surface of knob recesses 45.

Spring-loaded detent locking assemblies 42 themselves are relatively small cylindrical objects the bodies of which are made up of spring housings 72. The outer ends of spring housings 72 are equipped with a slightly extending detent ball, 74. Detent balls 74 are retained within spring housings 72 by the use of retainer flanges, 80, which are simply inward extensions of the inner walls of spring housings 72. Detent balls 74 are held against retainer flanges 80 by detent springs, 78. Detent springs 78 are expansion biased springs that are contained on their opposite ends by spring plugs 76 that close off the other ends of spring housings 72. This manner of construction provides protruding detent balls 74 that are capable of engaging detent locking depressions 56, but are also capable of deflecting back into spring housings 72 as needed.

Spring-loaded detent assemblies 42 come into play as plate selector knobs 26 are rotated to select the desired number of weight plates 18. During this operation, detent locking depressions 56 rotate around a specified path over spring-loaded detent assemblies 42 and their extending detent balls 74. At differing intervals along this path, detent balls 74 engage one of detent locking depressions 56, thereby locking plate selector knob 26 in a specific location. The location of detent locking depressions 56 corresponds to an exact lateral position of selector shafts 32. Thus, spring-loaded detent assemblies 42 provide the user of the disclosed apparatus with a method to ensure and monitor the exact number of inner weight plates 18 that are selected for a specific training exercise.

An alternative embodiment of the disclosed apparatus has been contemplate in which locking mechanism 40 consists of two smaller locking tangs, 50, that are illustrated in FIGS. 14, 15, and 16. In this embodiment, plate locking mechanisms 40 are primarily made up of two locking tangs, 48, and locking slots 50 that are vertically oriented with respect to one another along the central vertical axis of inner weight plates 18. These locking tangs and slots 48 and 50, respectively, are constructed by making a three-sided cut through body of inner weight plate 18. The area inside of the cut then is bent outward thereby forming locking tang 48; the gap left by the bending of locking tang 48 then forms locking slot 50. Additionally, the cut is made at an angle so that locking tang 48 has inwardly oriented beveled edges, 52. The result of this process is a inner weight plate 18 having a pair of extending locking tangs 48 on one side and a pair of open locking slots 50 on the other.

The design of locking tangs and slots 48 and 50 is important to how inner weight plates 18 actually engage and release one another during the use of the disclosed apparatus. These components are constructed having a narrow end, 51, on the top and a wide end, 53 on the bottom. The locking and unlocking process is initiated by the user either lifting dumbbell handle assembly 12 and attached inner weight plates 18 or replacing the same back into waiting residual weight sets 23. This motion generally results in a vertical interaction between two inner weight plates 18 involved.

In the locking process when the bulk of the disclosed apparatus is reengaged with the residual weight sets 23, narrow end 51 of locking tang 48 slides into wide end 53 of locking slot 50. As the downward motion of the disclosed apparatus continues, locking tangs 48 moves further into locking slots 50. At this time, beveled edges 52 of these components come into play. Beveled edges 52 serve to draw inner weight plates 18 together so that they are perfectly aligned with one another (primarily measured by the alignment of selector shaft holes 46) at the end of the reconnection of residual weight sets 23 to dumbbell handle assembly 12 of the disclosed apparatus. Conversely, beveled edges 52 aid in the smooth release of the components of plate locking mechanism 40 when dumbbell handle assembly 12 and attached inner weight plates 18 are extracted for use in a training routine. As with the previous embodiment, the orientation of locking tangs and slots 48 and 50 is irrelevant to the operation of the disclosed apparatus.

Two further alternative embodiments of the disclosed apparatus also have been contemplated and are further illustrated in FIGS. 17, 18, 19, and 20. These embodiments both employ electrical components to position selector shafts 32 to engage the desired number of inner weight plates 18. While this may be accomplished by any number of mechanisms, two primary possible configurations will be described. However, the confinement of the following discussion to these specific mechanisms is purely for simplicity and illustrative purposes and should not be construed as limiting the scope of the disclosed apparatus.

The first of the two configurations employs the use of two independent selector shaft drive mechanisms, 81, one each located in two inner plate housing wedges 20 of dumbbell handle assembly 12. In this configuration, each inner plate housing wedge 20 is equipped with a bipolar stepper motor, 82, a battery pack, 86, a control panel, 88, and an integrated circuit board, 90. These components then operate together to control the position of selector shafts 32 with respect to inner weight plates 18.

Control panel 88 in this embodiment of the disclosed apparatus is mounted on the upper surface of inner plate housing wedges 20 in a manner so that they are easily accessible to the user. Control panel 88 then is connected to bipolar stepper motor 82 through integrated circuit board 90. Integrated circuit board 90 processes the signal sent to it from control panel 88 and then sends the appropriate commands to bipolar stepper motor 82. This configuration provides the means by which selector shafts 32 are controlled through the use of bipolar stepper motor 82.

Bipolar stepper motor 82 then provides the rotational force necessary to rotate pinion 38 through motor shaft 84. Pinion 38 in turn drives selector shafts 32 through its interaction with selector shaft rack 36. The power necessary to operate these components is provided by a battery pack, 86. The selection of the desired amount of weight by the user's interaction with the control panels 88 serves to slide selector shafts 32 in and out of inner weight plates 18, thereby engaging the proper number. Thus, the use of selector shaft drive mechanism 81 allows the user to select the desired weight simply by choosing the proper sequence on control panel 88.

The second configuration of the disclosed apparatus employing electrically powered weight selection capabilities uses a single linear actuator stepper motor, 92. In this manner of construction, linear actuator stepper motor 92 is centrally positioned within dumbbell handle assembly 12. In this embodiment of the disclosed apparatus, linear actuator stepper motor 92 is directly connected to each of selector shafts 32 by use of actuator drive screws, 100. Two actuator drive screws 100 extend outward from either side of linear actuator stepper motor 92 and are equipped with an outer surface comprising of right handed threads, 110, on one side of linear actuator stepper motor 92 and left hand threads, 112, on its other side.

Additionally, the longitudinal centers of two selector shafts 32 are equipped with a centrally bored screw hole, 102. The surfaces of these screw holes 102 are manufactured with right and left hand threads, 110 and 112, that correspond to those on actuator drive screws 100. Threaded surfaces on the actuator drive screws 100 and screw holes 102 of selector shafts 32 are threaded together within dumbbell handle assembly 12 to form the core of selector shaft drive mechanism 81.

The selector shafts are also equipped with keyway grooves, 106, formed into their lower most surfaces with respect to the general orientation of dumbbell handle assembly 12. Keyway grooves 106 perform two important functions with respect to the operation of this embodiment of the disclosed apparatus. The first is to allow for the passage of actuator wiring, 104, from the control components to linear actuator stepper motor 92. The second function of keyway grooves 106 is to rotationally lock selector shafts 32 within dumbbell handle assembly 12. This is accomplished by the placement of a keyway stop, 108, at the distal end of keyway groove 106 with respect to linear actuator stepper motor 92. Keyway stop 108 is a protruding tab that is shaped and sized to match the interior of keyway groove 106. By its engagement of keyway groove 106, keyway stop 108 rotationally locks selector shafts 32 while allowing for their longitudinal movement within dumbbell handle assembly 12. This manner of construction then allows for the rotational motion of actuator drive screws 100 to be transferred to lateral motion in selector shafts 32. Thus, the single action rotation of linear actuator stepper motor 92 is employed to move two selector shafts 32 in and out relative to the remaining components of the disclosed apparatus, thereby simplifying both the construction and manner of operation of this embodiment of the disclosed apparatus.

Linear actuator stepper motor 92 is controlled by the use of a single control panel, 88, located on the upper surface of one of inner plate housing wedges 20 of dumbbell handle assembly 12. Control panel 88 then is electrically connected to linear actuator stepper motor 92 through integrated circuit board 90. These components are supplied with the necessary power by battery pack 86. Additionally, actuator wiring 104 establishing this connection runs from integrated circuit board 90 to linear actuator stepper motor 92 through keyway groove 106, as described above.

Finally, this embodiment of the disclosed apparatus is equipped with two additional features that contribute to its overall operation. The first of these is a counter, 94. Counter 94 is a device that keeps track of the number of repetitions of an exercise or the number of sets of an exercise performed by the user. Counter 94 can be comprised of a number of different mechanisms ranging from the simplicity of a pedometer to more complex (and capable) electronic devices.

The second ancillary feature is a pressure switch, 96, and associated pressure switch wiring, 98. Pressure switch 96 is located on the lower surface of one of inner plate housing wedges 20 and it is activated when placing the disclosed apparatus on a flat hard surface. Pressure switch 96 operates to allow for the operation of selector shaft drive mechanism 81. When pressure switch 81 is activated by placing the disclosed apparatus on a hard an flat surface, the system is powered up and the user is free to adjust the number of inner plates 18 that are engaged. Conversely, when the disclosed apparatus is lifted off the floor and the pressure switch is deactivated, selector shaft drive mechanism 81 is powered down. This means that selector shafts 32 cannot be moved and the disclosed apparatus is safe to use for its intended purpose.

Thus, the method of using a single linear actuator stepper motor 92 for controlling the position of disclosed apparatus's selector shafts 32 allows a user to control the operation of both selector shafts 32 through the simple operation of single control panel 88 providing the simplest possible mechanism of selecting the desired amount of weight.

Thus, the method of using single linear actuator stepper motor 92 for controlling the position of disclosed apparatus's selector shafts 32 allows a user to control the operation of both selector shafts 32 through the simple operation of single control panel 88 providing the simplest possible mechanism of selecting the desired amount of weight.

It will be apparent to the skilled artisan that a single knob could replace the pair of knobs disclosed and be connected to both selector shafts so that rotation of a single knob controls the number of weight plates selected in both weight sets. Such single knob could be associated with each weight set or directly with the handle. Also, the tangs could be welded onto the weight plates rather than integrally formed from the weight plates. A myriad of additional variations to the disclosed weight assembly, then, can be envisioned by the skilled artisan within the spirit and scope of the disclosure set forth herein.

While the apparatus has been described with reference to various embodiments, those skilled in the art will understand that various changes may be made and equivalents may be substituted for elements thereof without departing from the scope and essence of the disclosure. Additionally, many modifications may be made to adapt a particular situation or material to the teachings of the disclosure without departing from the essential scope thereof. Therefore, it is intended that the disclosure may not be limited to the particular embodiments disclosed, but that the disclosure will include all embodiments falling within the scope of the appended claims. In this application the US measurement system is used, unless otherwise expressly indicated. Also, all citations referred to herein are expressly incorporated herein by reference.

I claim:

1. An adjustable weight set comprising:

(a) an annular hand graspable handle assembly having a pair of rod apertures;

(b) a pair of rack shafts disposed within said handle assembly each said rack shaft having a series of grooves disposed along its length;

(c) a pair of spaced apart weight assemblies disposed about said handle assembly to reveal a centrally disposed hand grip portion of said handle assembly, each weight assembly comprising:

(i) a inner wedge assembly and a outer wedge assembly in spaced apart relationship, each wedge assembly having an inner slanted face that can carry said handle assembly;

(ii) at least two slanted weight plates disposed between each of said outer and inner wedge assemblies;

(iii) each said slanted weight plate having a trapezoidally-shaped tang extending from the side and adjacent to a locking slot in the weight plate, each adjacent weight plate interlocking by a tang of one weight plate inserted into the locking slot of an adjacent weight plate;

there being a centrally disposed hole in each weight plate configured to receive said handle assembly;

(d) a knob assembly carried by each inner wedge assembly and comprising:

(i) a hand rotatable detented knob accessible by a user and carrying a series of detent depressions thereabout, each knob detent depression corresponding to one slanted weight plate;

(ii) a rod having an upper end affixed to said knob and a lower end extending through said handle assembly rod aperture and affixed to a rotatable notched pinion, said pinion notches matable with said rack shaft grooves where rotating said knob causes said pinion to rotate which in turn moves said rack shaft to move inside said handle assembly underneath said slanted weight plates;

whereby rotating each said knob causes each said rack shaft to move back and forth within said handle assembly to support a defined number of slanted weight plates for use by said user.

2. The adjustable weight set of claim 1, wherein said knob is detented with a detent assembly that is spring biased.

3. The adjustable weight set of claim 1, wherein said inner wedge assemblies, said outer wedge assemblies, and said weight plates are made from metal.

4. The adjustable weight set of claim 1, wherein each inner wedge assembly has a recess in which said rotatable knob is disposed.

5. The adjustable weight set of claim 1, wherein said handle assembly is terminated with a pair of handle collars that mate with said inner wedge assemblies.

6. The adjustable weight set of claim 1, wherein said tangs and said weight plates are formed from metal, and said tangs are welded onto said weight plates.

7. An adjustable weight set adjustable comprising:

(a) an annular hand graspable handle assembly having a pair of rod apertures;

(b) a pair of rack shafts disposed within said handle assembly each said rack shaft having a series of grooves disposed along its length;

(c) a pair of spaced apart weight assemblies disposed about said handle assembly to reveal a centrally disposed hand grip area of said handle assembly, each weight assembly comprising:

(i) a inner wedge assembly and a outer wedge assembly in spaced apart relationship, each wedge assembly having an inner slanted face that can carry said handle assembly;

(ii) a plurality of slanted weight plates disposed between each of said outer and inner wedge assemblies;

(iii) each said slanted weight plate having a trapezoidally-shaped tang bent to the side to leave a locking slot in the weight plate, each adjacent weight plate interlocking by a tang of one weight plate inserted into the locking slot of an adjacent weight plate;

there being a centrally disposed hole in each weight plate configured to receive said handle assembly;

(d) a knob assembly carried by each inner wedge assembly and comprising:

(i) a hand rotatable knob accessible by a user and carrying a series of detent depressions thereabout, each knob detent depression corresponding to one slanted weight plate;

(ii) a rod having an upper end affixed to said knob and a lower end extending through said handle assembly rod aperture and affixed to a rotatable notched pinion, said pinion notches matable with said rack shaft grooves where rotating said knob causes said pinion to rotate which in turn moves said rack shaft to move inside said handle assembly underneath said slanted weight plates;

(iii) a biased detent assembly disposed to mate with the detent depressions of said knob;

whereby rotating each said knob causes each said rack shaft to move back and forth within said handle assembly to support a defined number of slanted weight plates for use by said user.

8. The adjustable weight set of claim 7, wherein said detent assembly is spring biased.

9. The adjustable weight set of claim 7, wherein said inner wedge assemblies, said outer wedge assemblies, and said weight plates are made from metal.

10. The adjustable weight set of claim 7, wherein each inner wedge assembly has a recess in which said rotatable knob is disposed.

11. The adjustable weight set of claim 7, wherein said handle assembly is terminated with a pair of handle collars that mate with said inner wedge assemblies.

* * * * *